United States Patent [19]

McKittrick et al.

[11] Patent Number: 4,653,962

[45] Date of Patent: Mar. 31, 1987

[54] RETAINING WALL CONSTRUCTION AND METHOD OF MANUFACTURE

[75] Inventors: David P. McKittrick, Washington, D.C.; Thomas C. Neel, Springfield; John M. Carey, Ashburn, both of Va.

[73] Assignee: The Reinforced Earth Company, Arlington, Va.

[21] Appl. No.: 788,327

[22] Filed: Oct. 17, 1985

[51] Int. Cl.[4] ..... E02D 29/00

[52] U.S. Cl. ..... 405/286; 405/262; 405/284

[58] Field of Search ..... 405/285, 284, 286, 287, 405/258, 262

[56] References Cited

U.S. PATENT DOCUMENTS

| | | | |
|---|---|---|---|
| 932,261 | 8/1909 | Flynn | 405/284 X |
| 2,439,606 | 4/1948 | Hurt | 405/285 |
| 3,155,206 | 11/1964 | Booth | 405/285 X |
| 3,421,326 | 1/1969 | Vidal | 405/284 |
| 3,466,874 | 9/1969 | Holl | 405/262 |
| 3,686,873 | 8/1972 | Vidal | 405/266 |
| 4,116,010 | 9/1978 | Vidal | 405/262 |
| 4,324,508 | 4/1982 | Hilfiker et al. | 405/284 |
| 4,369,004 | 1/1983 | Weatherby | 405/262 |

FOREIGN PATENT DOCUMENTS

| | | | |
|---|---|---|---|
| 2102866 | 2/1983 | United Kingdom | 405/284 |

OTHER PUBLICATIONS

"Novel Cylinder Pile Wall Protects Seattle Freeway", by Roads and Streets, Nov. 1962.

*Primary Examiner*—Cornelius J. Husar
*Assistant Examiner*—Todd G. Williams
*Attorney, Agent, or Firm*—Allegretti, Newitt, Witcoff & McAndrews, Ltd.

[57] ABSTRACT

An improved anchor wall includes a series of vertical caissons cast in place along a line defining the boundary of the wall. Soil is executed from one side of the line and anchor rods are used to attach the caissons to the remaining soil. Discrete panels are then stacked one upon the other and attached by a reinforced concrete rib to the vertical caissons.

13 Claims, 9 Drawing Figures

RETAINING WALL CONSTRUCTION AND METHOD OF MANUFACTURE

BACKGROUND OF THE INVENTION

This invention relates to an improved retaining wall and more particularly to an anchor or tie back wall.

Retaining walls generally constitute a vertical support barrier for an earthen embankment. The forces of the embankment on a vertical retaining wall can be calculated in view of the characteristics of the earthen material being retained and the height of the wall. Such calculations enable engineers to design a particular type of retaining wall. That is, the design and construction of various retaining walls depends upon the materials utilized to make the wall and the particular construction technique involved.

For example, a typical retaining wall may be made of reinforced concrete cast in place. Typically for a cast in place wall, a large concrete pedestal is cast at the base of the wall having an extension which projects into or underlies the embankment that is to be retained. An integral upstanding, vertical wall is cast on the base. The dimensions and other characteristics of such cast in place wall can be determined using standard or known engineering techniques.

Another type of retaining wall is base on earth reinforcement techniques as disclosed in Vidal, U.S. Pat. No. 3,421,326 entitled "Constructional Works" and Vidal, U.S. Pat. No. 3,686,873 entitled "Constructional Works". This type of retaining wall is designed in accord with techniques and methods developed by Vidal.

Yet another type of retaining wall is known as an anchor wall or a tie back wall. With an anchor wall, vertical members that support the wall are maintained in place by anchors which are attached to the members and extend back into the earthen embankment. Various types of cross members are connected to the vertical members to form a total wall structure. Again the design dimensions of this type of wall can be calculated using known civil engineering techniques.

A particular type of anchor wall which has been constructed requires, as a first step, drilling of vertical passages or holes along a line defining the wall. Reinforced concrete posts are then cast into these vertical passages. The earth is then stripped away from one side of the vertical posts. As the earth is stripped from one side of the posts, the vertical posts are anchored into position by means of anchors through the posts into the remaining earthen embankment. Thus, as the earth is stripped away from one side and anchors are attached and fastened into the earthen embankment, a facing of the earthen embankment is exposed defined generally by the line of the wall. It is then possible to put cross members between the vertical posts to retain the earth. For example, the reinforced concrete posts may be connected by a cast in place panel.

Though such an anchor wall is very useful and the design dimensions for such a wall can be calculated using known techniques, there has remained a need and desire to provide a more efficient wall of this general type which utilizes fewer caissons or vertical posts per unit length of wall and which may be easily and quickly constructed at a construction site with a minimum amount of casting necessary at that site.

SUMMARY OF THE INVENTION

In a principal aspect, the present invention comprises an improved retaining wall which includes (1) a series of spaced, substantially vertical, structural members or posts that extend from below grade level vertically upward, and (2) a plurality of prefabricated, generally transverse, soil retention members stacked to form a wall with each soil retention member connected to two of the vertical members by a special means for connecting or attachment construction.

Construction of the wall begins by forming the vertical structural members as reinforced concrete caissons in borings drilled in the soil. The caissons are positioned along a line substantially defining the wall boundary. Earth is then excavated along one side of the caissons to a depth equivalent to the height of the retaining wall. Anchoring means are generally provided for attaching the caissons to the unexcavated embankment of soil. The soil retention members are then positioned in stacked array along the exposed side of the vertical caissons. Overlapping reinforcing members which extend from the caissons as well as the soil retention members are retained in a cast concrete rib that forms a connection for the stacked retention members to the caissons. After the soil retention members are attached to the vertical caissons, the space between the soil facing and the soil retention members is filled in with granular material such as crushed rock.

As an alternative feature, a temporary soil retention facing is applied on the excavated soil wall surface prior to stacking and attachment of the soil retention members to the vertical caissons. The retention facing is made by attaching wire mesh to the soil face and then spraying concrete over that wire mesh.

An important feature of the invention relates to the means for connecting the soil retention members to the vertical structural members or caissons. The preferred means for connecting comprises a reinforced concrete connection or rib which is cast in place after the soil retention members are properly juxtapositioned with respect to the vertical structural members. Thus, a reinforced concrete rib is cast in place as a connection member between the stacked soil retention members and the vertical structural members.

Consequently, it is an object of the invention to provide an improved retaining wall comprised of spaced, vertical, structural members or caissons in combination with a series of stacked, generally transverse, soil retention members connected to the vertical members.

Still a further object of the invention is to provide an improved retaining wall structure and method of construction, including a means for attaching a series of stacked soil retention members to vertical structural members that extend from below grade to a desired wall height.

Yet a further object of the invention is to provide a method for construction of a retaining wall wherein vertical structural members for the wall may be spaced a greater distance relative to comparable prior art methods while maintaining the safety and integrity of such a wall.

Another object of the invention is to provide a retaining wall construction comprised of a number of transverse soil retention members stacked one upon the other to form a wall and wherein the soil retention members are attached by means of a reinforced concrete, connecting rib to vertical structural members extending from below grade level vertically upward to the level of the wall.

A further object of the invention is to provide an improved retaining wall construction which can be easily assembled at a site with a minimal amount of on-site forming and pouring of concrete.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

FIGS. 1 through 4 illustrate a known prior art method for the construction of a concrete retention wall utilizing caissons or vertical structural members which are cast in place in the field in combination with vertical wall panels which are also cast in place in the field. FIGS. 5 through 9 illustrate the improved retaining wall construction of the invention as well as the method for building such a retaining wall.

Figure 1:
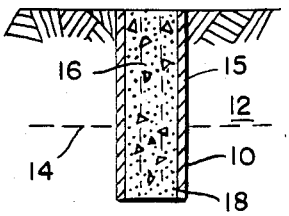
FIG. 1 (Prior Art)
FIG. 1 is a schematic side cross sectional view of an initial step in a prior art method of forming a retaining wall.

Referring first, therefore, to the prior art depicted in FIGS. 1 through 4, and in particular the beginning steps represented by FIG. 1, vertical support members 18 are initially fabricated for the wall. Thus, typically a site for the wall is chosen. At that site a series of spaced vertical borings are made in the soil embankment. For example as shown in FIG. 1, a boring 10 in the soil 12 will be made. Typically a series of borings 10 along a line defining the retaining wall will be made. The borings 10 will typically be spaced approximately 6 feet and perhaps up to 10 feet one from the other. The diameter of the borings 10 is typically 25 to 36 inches. The borings 10 extend below the ultimate grade level 14 of a wall as depicted in FIG. 1.

A cylindrical form 15 and reinforcing cage 16 of reinforcing steel bar (shown in phantom in FIG. 1) are inserted into each boring 10. Form 15 may have a shape other than cylindrical depending upon soil conditions, engineering judgment, etc. The reinforcing cage 16 is upstanding in the vertical boring 10. Concrete is then poured into the boring 10 so that a vertical pillar or caisson 18 will be defined within the boring 10. The vertical structural members 18 for each of the borings 10 are thus formed along a line defining the retaining wall.

Figure 2:
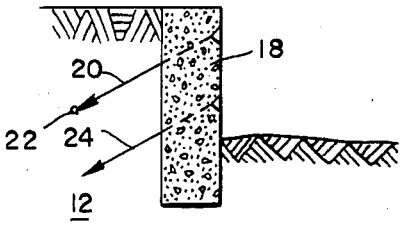
FIG. 2 (Prior Art)
FIG. 2 is a schematic side view of a subsequent step in the formation of the prior art retaining wall.

Referring next to FIG. 2, subsequent steps in the construction of the wall are depicted. There it is shown that an anchor rod or tie wire 20 is attached through the structural member 18 and is anchored by appropriate anchor means 22 into the earth or soil 12. This is accomplished after earth or soil 12 is removed from one side of the line defined by the caissons 18. Thus, as a first layer of the soil or earth 12 is removed, a first row of tie wires 20 may be inserted. Then a next layer of soil 12 may be removed and a second row of tie wires 24 may be attached to anchor the caissons 18. In this manner, the vertical caissons 18 define a vertical structural support extending from below grade level 14 as depicted in FIG. 2 to a level of approximately equal to the height of the final retaining wall. Caissons 18 are retained in the vertical position by tie wires 20, 24.

Figure 3:
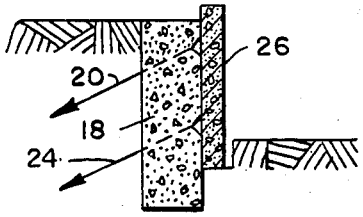
FIG. 3 (Prior Art)
FIG. 3 is a further schematic view of step in the method represented by FIGS. 1 and 2.
Figure 4:
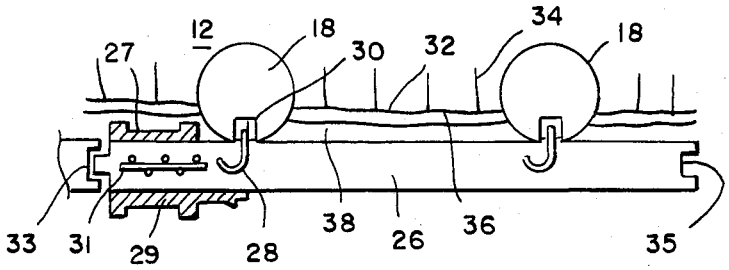
FIG. 4 (Prior Art)
FIG. 4 depicts subsequent steps in the building of a prior art retaining wall.

As a next step in the construction of such a retaining wall, a cast in place, front, vertical wall panel 26 is built as illustrated by FIGS. 3 and 4. As shown in FIG. 4, a back form 27 for the panel or wall 26 is positioned on a plane defined by the outside exposed surfaces for the vertical members or caissons 18. Alternatively, the soil face may serve as a form surface. A front form 29 spaced from back form 27 defines the front of the wall 26. A reinforcing bar grid 31 is positioned between the forms 27, 29. Curved reinforcing bars 28 are threadably inserted into connectors 30 cast in the caissons 18. The bars 28 project into the region defined between the forms 27, 29 for the panel 26. The forms 27, 29, once completed, define a space which is then filled with concrete on site. The forms 27, 29 are then removed leaving the vertical cast in place panel 26 attached to pairs of adjacent caissons and extending from slightly below grade level as shown in FIG. 3 to the desired height. The panel 26 is usually constructed with a tonque 33 along one side and a groove 35 along its opposite side for cooperation with the next panel to be cast.

In order to facilitate the construction of the forms 27, 29 for the panel 26, the soil 12 is generally removed from the region between the caissons 18 for a distance which will permit insertion of back form 27. To keep the soil 12 from flaking or falling during this operation, it has been found that wire netting 32 retained by small anchors 34 projecting into the soil 12 may be positioned on the free face of the soil 12 that has been excavated. As a further protection against deterioration of the soil surface or exposed wall during the casting operation for the panel 26, concrete may be sprayed onto the wire netting 32. Thus, a sprayed concrete facing 36 will retain the soil 12 during the casting of the wall panel 26. Once the wall panel 26 is cast and the forms 27, 29 are removed, a back fill of granular material 38 may be dumped or positioned between the facing 36 and the panel 26. With the construction as described, it is possible to space the vertical caissons 18 approximately 6 to 8 feet or more if a sprayed concrete facing 36 is used. The panels 26 require on site assembly and installation of forms 27, 29. The particular dimensions of caissons 18, panels 26, anchor wires 20, 24, and the reinforcing components therefore are determined using standard civil engineering techniques.

FIGS. 5 through 8 illustrate the improved anchor wall construction of the present invention. With the improved anchor wall construction of the present invention the initial steps in the formation of the anchor wall represented by FIGS. 1 and 2 are replicated. That is, caissons 18 are poured into borings 10 in the soil 12 along the line of the defined wall as shown in FIG. 1. As depicted by FIG. 2, the facing of the soil 12 is then exposed by cutting away the soil 12 on one side of the wall defined by the caissons 18. As the excavation operation is taking place, anchor wires 20 and 24 are provided for anchoring and retaining the caissons 18 in their vertical position. It is possible, however, with the present invention to space the caissons 18 a greater distance than with the prior art construction described above. Thus, the caissons 18 may be typically spaced upwards of 10 to 12 feet from one another.

With the present invention, it is also possible to utilize wire netting or mesh 32 held by anchors 34 to retain the unexcavated soil 12. It is also possible to utilize the procedure of spraying the wire mesh 32 with a concrete facing 36 in order to retain the soil surface and prevent it from flaking.

Figure 5:
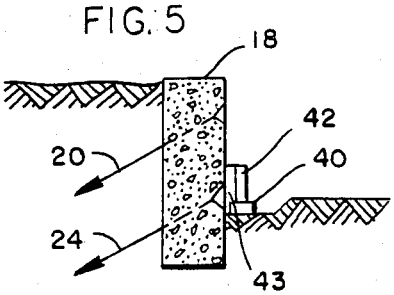
FIG. 5 is a schematic view depicting a sequential step in the construction of a retaining wall using the improved method of building a retaining wall according to the present invention.

Having established the caissons 18 is position and having provided a wire mesh 32 with a concrete support wall or facing 36 between the caissons, the subsequent prior art procedures are supplanted with a novel series of steps. Typically, a footing 40 is provided along the base of the wall as depicted in FIG. 5. The footing 40 may be precast or cast in place. The footing 40 may be placed in a trench below grade level 14 or maintained at grade level.

Figure 6:
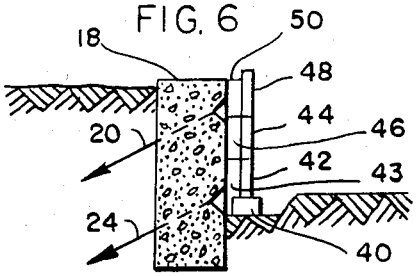
FIG. 6 is a schematic view depicting a further sequential step in building the wall of the present invention.

Next a first course or row of precast transverse soil retention members 42 are provided and arranged on the footing 40. The members 42 are spaced slightly from the vertical caissons 18. The spaced soil retention members 42 are then attached to the caissons 18 by means of a reinforced concrete connection 43 which is depicted in detail in FIGS. 7 and 8. Subsequently, as represented by FIG. 6, a second layer of generally transverse soil retention members 44 is positioned on top of the first layer of members 42. The second layer is likewise connected by connection means 46 to the vertical caissons. To the extent necessary, a third layer of members 48 is positioned on the second layer 44. Again, an envelope or connection means 50 is provided to connect the third layer of members 48 to the caissons 18. Finally, granular material or back fill 38 is provided between the surface 36 of the sprayed concrete netting 32 and the back side of the layers of soil retention members 42, 44 and 48.

Figure 7:
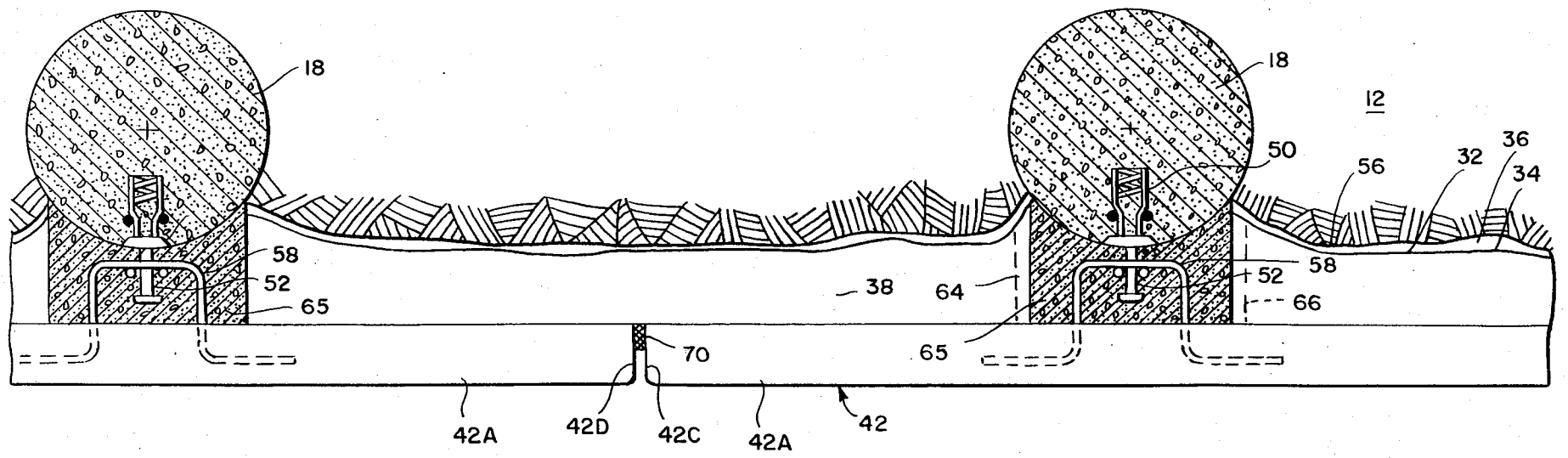
FIG. 7 is an enlarged top plan, cross sectional view of the improved retaining wall construction of the present invention.
Figure 8:
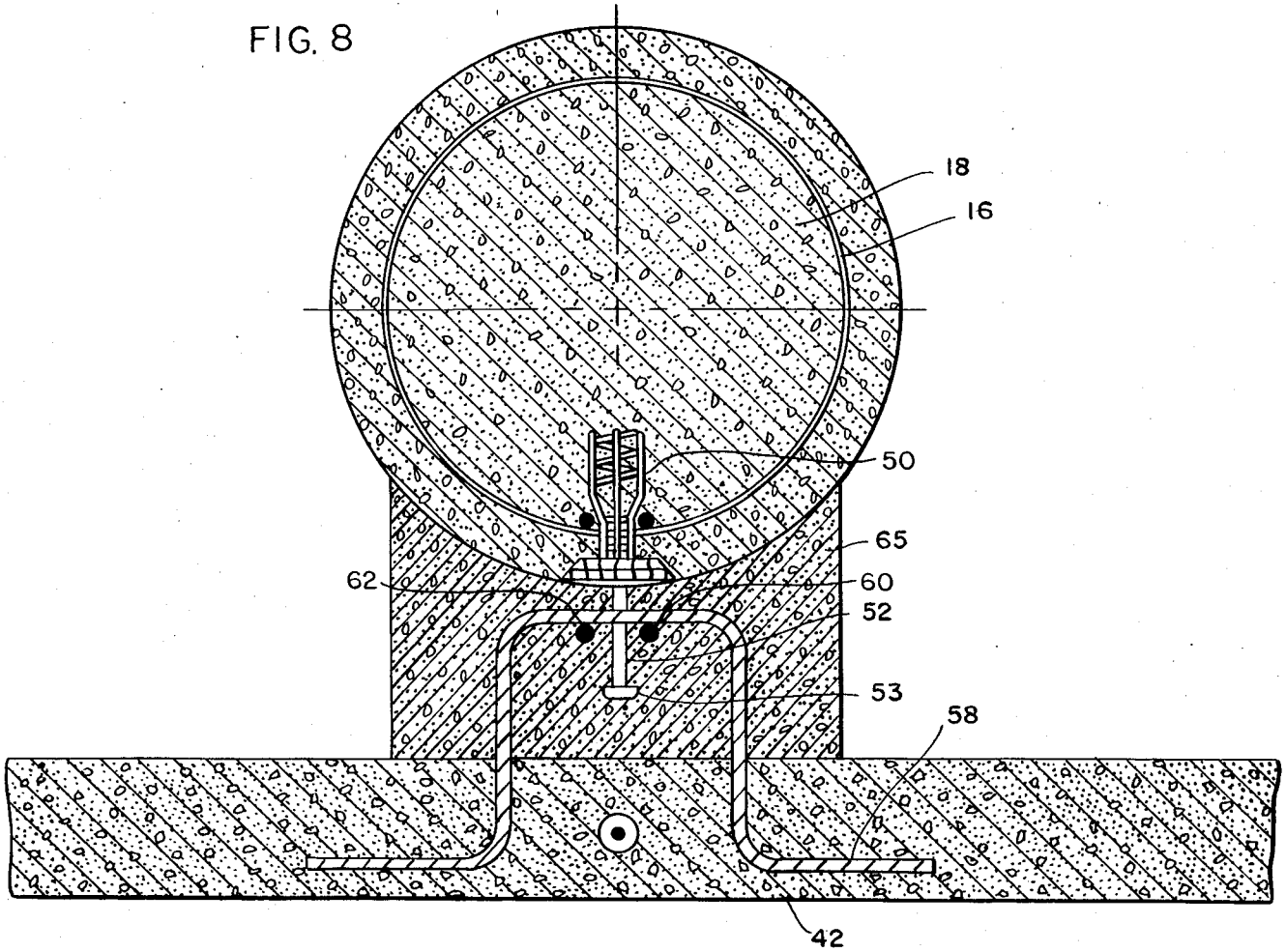
FIG. 8 is a further enlarged top plan, cross sectional view of the retaining wall of the present invention illustrating in detail the means for connecting retaining wall elements to a vertical structural member.
Figure 9:
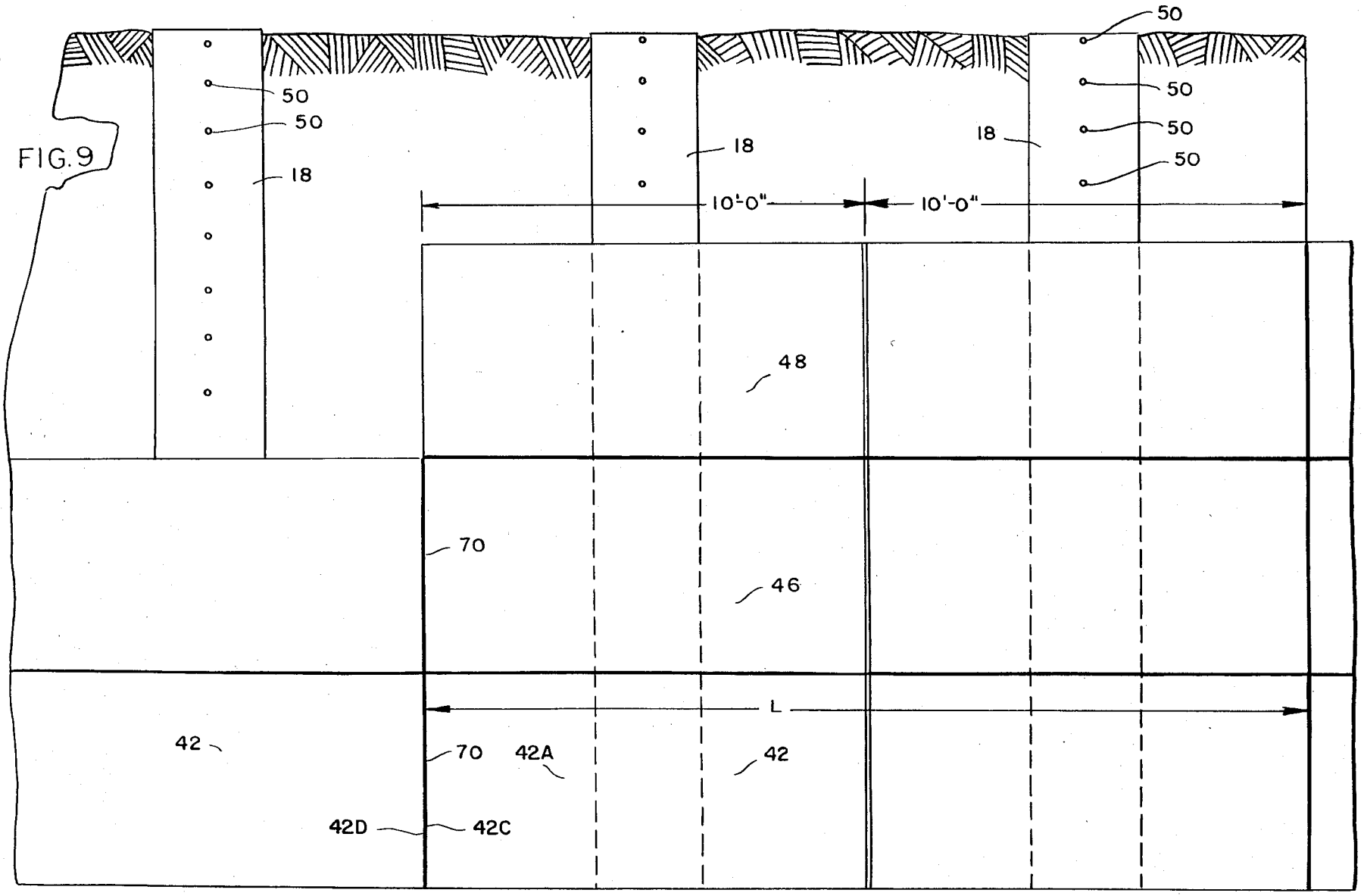
FIG. 9 is a front plan view of the wall of the invention.

FIGS. 7, 8 and 9 illustrate these construction steps and the attachment means for the transverse soil retention members 42, 46, 48 in greater detail. Referring particularly to FIG. 7, there is illustrated a series of caissons 18 which are aligned on the general line of the wall for the embankment, i.e. the soil retention wall. The caissons 18 are of reinforced concrete construction cast in the field in the manner previously described.

As shown in FIGS. 7, 8 and 9, each of the vertical caissons 18 include a series of spaced connector inserts 50. Inserts 50 are arranged in vertical line, as shown in FIG. 9, along the exposed front face of the caisson 18. The connection inserts 50 are cast into the caissons 18 and cooperate with connectors 52 that are threaded into the inserts 50 after the soil 12 is cut away from the front face and side of the caissons 18. The connectors 52 thus project 4 or 5 and preferably 6 inches from the caissons 18 and are rigidly attached thereto by means of the connector inserts 50. In the preferred embodiment, each connector 52 has the configuration of a large, headed bolt which is threaded at one end to cooperate with insert 50 and which has a large head 53 at its opposite end. Connector 52 is a reinforcing steel component of the wall.

As particularly depicted in FIG. 7, the soil 12 is cut away to expose a soil face 56. Positioned against that face 56 is wire netting 32 held in place by wire anchors 34. Concrete may then be sprayed on the netting 32 to form a temporary support wall 36 extending between the vertical caissons 18. This support wall 36 is optional and may be used over the entire soil face 56 which is exposed or only a portion thereof since it is contemplated that the wall 36 is merely temporary and is intended to support the soil surface 56 only during the fabrication of the total wall.

As depicted in FIG. 9, a series or course of prefabricated generally transverse soil retention panels 42 are arranged side by side on the footing 40. The panels 42 are formed of precast, reinforced concrete and have a lateral dimension "L" in FIG. 9 equal to approximately two times the center line spacing of adjacent caissons 18. In this manner it is assured that the panels 42 will cooperate with two, but no more than two caissons. Each retention member 42 includes two parallel rows of "U" bars 58 as shown in FIG. 8 cast to project from the back side of the panels 42 along vertical rows. Thus, the "U" bars 58 of each vertical row are positioned so that they fit generally adjacent and slightly above or below the row of connectors 52 in a caisson 18. Once the panels 42 are properly arranged and spaced from the caissons 18 so that the "U" bars 58 overlap the connectors 52, it is possible to insert additional reinforcing bars such as bars 60 and 62 vertically adjacent and parallel to the caissons 18. Subsequently forms such as depicted in phantom in FIG. 7 as forms 64 and 66 are positioned in a parallel, vertical array generally transverse to the panel 42 and against the caisson 18. Concrete is then poured between the forms 64 and 66 to define a reinforced concrete connection or rib 65 between the panel 42 and the caisson 18. Thus, the forms 64 and 66 define an envelope in which a reinforced concrete connection or rib 65 is provided and defined.

Importantly, the "U" bars 58 are positioned in rows at approximately one quarter of the distance from the opposite edges of the panel 42. Thus, the connection between the panel 42 and the caissons 18 is provided intermediate the ends of the panels 42 rather than at the ends of the panels 42. Consequently, portions 42A in FIG. 7 of the panel 42 extend in cantilever fashion beyond the connection or rib 65 from the respective caissons 18. In like fashion further single panels 42 are attached to appropriate pairs of adjacent caissons 18. As depicted in FIG. 9, the free ends 42C, 42D of the panels 42 then abut one another. A joint is formed between the adjacent panels 42 and a filter material such as cork filter 70 in FIG. 7 is positioned in the region between the abutting panels 42.

The remainder of the retaining wall is constructed as depicted by FIGS. 6 and 9. Generally transverse soil retention members are arranged in a stacked relation one upon the other. Thus, panels 46 are stacked directly on top of panels 42 with the sides aligned. Subsequent panels 48 are stacked on panels 46 again with their sides aligned. All of the panels 42, 46, 48 are attached to the caissons 18 in the manner previously described. By stacking the panels 42, 46 and 48 in the manner described, the panels 42, 46, 48 do not overlap. As a result, the flexibility of the wall is enhanced and the strains and stresses on the various caissons 18 are maintained in a generally uniform manner thereby avoiding transfer of stress between nonadjacent caissons 18. Nonetheless, it is possible to fabricate the retaining wall by alternating the panels so that rather than lying one above the other, they would be stacked in an alternating pattern and thus connected to alternate caissons.

After all of the panels 42, 46, 48 are connected to their appropriate caissons 18, a granular back fill material 38 such as back fill material 38 in FIG. 7 is placed intermediate the panels 42, 46, 48 and the temporary support surface 56.

It is possible, of course, to vary the configuration and arrangement of the panels 42, 46, 48. It is also possible to vary the spacing of the caissons 18. With the construction of the present invention in combination with a sprayed concrete facing, it has been found that the caissons 18 may be separated by a greater distance than with prior art retention walls such as described previously without a sprayed concrete facing. Where caissons 18 associated with the prior art wall are spaced between 6 to 8 feet, a minimum spacing of 10 feet between caissons 18 is now possible. Thus, an increase of $\frac{1}{4}$ to $\frac{1}{3}$ of the spacing of caissons is possible.

With the construction of the present invention, it is also possible to use panel members of smaller dimension which may be transported to a site rather than cast in place. The amount of in place casting at a site is minimized. This eliminates the requirement for forms on a site and improves the efficiency and speed at which such a retaining wall may be constructed. Thus, while there has been set forth a preferred embodiment of the invention, it is to be understood that the invention is to be limited only by the following claims and their equivalents.

What is claimed is:

1. An improved retaining wall construction for retaining soil at grade level on one side of the wall with the soil being excavated to an excavated level on the other side of the wall, said wall construction comprising, in combination:

a series of spaced, substantially vertical, structural members extending from below the excavated level vertically upward approximately to the grade level of the wall;

a plurality of prefabricated, generally transverse, concrete soil retention panel members connected to the vertical members at least at two horizontally spaced connecting points thereby defining a retention wall facing;

means for attaching said concrete soil retention panel members to the vertical members, said means for attaching including (1) a plurality of reinforcing fastening components attached to the vertical members above excavated level, said components generally positioned one above another and simultaneously projecting outward toward the plane of the wall, (2) reinforcing connecting components projecting from said concrete soil retention panel members at the spaced connection points generally in opposed relation to the fastening components, said connecting components spaced horizontally a distance substantially equal to the spacing of the vertical structural members, each of said soil retention panel members defining a panel section which projects horizontally from a vertical member and terminates intermediate vertical members to thereby define a horizontal panel, cantilever beam for retention of soil; and (3) a concrete envelope for the fastening components and connecting components which in combination comprises a reinforced concrete connection between each vertical member and the soil retention, panel members.

2. The wall construction of claim 1 including at least one vertical reinforcing bar in the concrete envelope.

3. The wall construction of claim 1 wherein the soil retention panel members comprise generally rectangular precast concrete panels.

4. The wall construction of claim 3 wherein the soil retention panel members comprise panels having their vertical side aligned.

5. The wall construction of claim 1 including at least two stacked rows of horizontally arranged soil retention panel members.

6. The wall construction of claim 1 including filler material in the joints between the soil retention panel members.

7. The wall construction of claim 1 in combination with temporary soil retention means affixed to the surface of soil retained behind the soil retention panel members.

8. The wall construction of claim 7 wherein the temporary soil retention means include a netting affixed over the soil surface, pin means connected to the netting and extending into the soil to hold the netting in place, and a concrete coating on the netting and soil face.

9. The wall construction of claim 1 wherein the vertical member is a reinforced concrete caisson.

10. The wall construction of claim 1 wherein the vertical members are spaced on centers substantially equal to or greater than 10 feet.

11. The wall construction of claim 1 wherein the fastening components are rods threadably attached to the vertical members along a generally vertical axis.

12. The wall construction of claim 1 wherein the connecting components comprised "U" shaped bars projecting from the soil retention panel members along a vertical axis.

13. A method for erection of a retaining wall construction comprising, in combination, the steps:

(a) positioning a series of substantially vertical, structural members in soil along a line demarking the wall construction, said vertical members extending from a position below grade level to approximately the height of the wall construction, said vertical members including a plurality of outwardly projecting reinforcing fastening components along one side in a vertical array;

(b) excavating the soil along one side of the line demarking the wall construction to form a generally vertical, soil surface along said line;

(c) positioning stacked series of courses of discrete wall panels in opposed relation to the vertical structural members, said discrete wall panels each having a length which exceeds the spacing between two adjacent vertical members, and also having connection components projecting from a back side of each panel and spaced in accord with the spacing of the vertical members, said connection components intermediate the ends of the panel, and positioned to overlay the reinforcing fastening components;

(d) attaching the panels to the vertical members by forming a reinforced concrete fastening joint therebetween by (e) filling any void intermediate said vertical soil surface and said back side of said wall panel.

* * * * *